US009371793B2

(12) United States Patent
Blumenstock et al.

(10) Patent No.: US 9,371,793 B2
(45) Date of Patent: Jun. 21, 2016

(54) METHOD FOR OPERATING A FUEL VAPOR RECIRCULATION SYSTEM IN A MOTOR VEHICLE

(71) Applicants: Andreas Blumenstock, Ludwigsburg (DE); Andreas Pape, Oberriexingen (DE)

(72) Inventors: Andreas Blumenstock, Ludwigsburg (DE); Andreas Pape, Oberriexingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 282 days.

(21) Appl. No.: 13/968,771

(22) Filed: Aug. 16, 2013

(65) Prior Publication Data

US 2014/0052361 A1 Feb. 20, 2014

(30) Foreign Application Priority Data

Aug. 17, 2012 (DE) ..... 10 2012 214 631

(51) Int. Cl.

| | |
|---|---|
| ***F02D 41/26*** | (2006.01) |
| ***F02D 41/02*** | (2006.01) |
| ***F02D 41/00*** | (2006.01) |
| *F02D 41/14* | (2006.01) |

(52) U.S. Cl.

CPC ..... *F02D 41/263* (2013.01); *F02D 41/003* (2013.01); *F02D 41/021* (2013.01); *F02D 41/0045* (2013.01); *F02D 2041/1412* (2013.01); *F02D 2200/701* (2013.01)

(58) Field of Classification Search

CPC ..... F02D 41/02; F02D 41/021; F02D 41/26; F02D 41/263; F02D 41/04; F02D 41/14

USPC ..... 701/8, 82, 94, 102, 108, 114, 115; 123/516–521

See application file for complete search history.

(56) References Cited

U.S. PATENT DOCUMENTS 5,836,291 A * 11/1998 Kinugasa ..... F02D 41/0032 123/520

2011/0029176 A1* 2/2011 Rauner ..... F02D 29/02 701/22

FOREIGN PATENT DOCUMENTS

| | | |
|---|---|---|
| DE | 697 17 716 | 9/2003 |
| DE | 10 2008 025 569 | 12/2009 |
| DE | 10 2009 035 845 | 2/2011 |
| JP | 2007-113549 | 5/2007 |
| JP | 2009-121353 | 6/2009 |

OTHER PUBLICATIONS

Jp 2007 113549 English Translation Version.*

Jp 2009 121353 English Translation Version.*

* cited by examiner

*Primary Examiner* — John Kwon

*Assistant Examiner* — Johnny H Hoang

(74) *Attorney, Agent, or Firm* — Norton Rose Fulbright US LLP

(57) ABSTRACT

A method for operating a fuel vapor recirculation system in a motor vehicle having a fuel tank. In the method, in the operating strategy of the fuel vapor recirculation system, predictive route data of the motor vehicle are taken into account.

11 Claims, 3 Drawing Sheets

METHOD FOR OPERATING A FUEL VAPOR RECIRCULATION SYSTEM IN A MOTOR VEHICLE

FIELD OF THE INVENTION

The present invention relates to a method for operating a fuel vapor recirculation system in a motor vehicle. Furthermore, the present invention relates to a computer program which carries out all the steps of the method according to the present invention, when it is run on a computer, as well as a data carrier which stores this computer program. Finally, the present invention relates to a control unit which is developed to carry out the method according to the present invention.

BACKGROUND INFORMATION

Motor vehicles having a gasoline-driven internal combustion engine are equipped, these days, with on-board devices which capture the gasoline vapors accumulating during the operation of the stopping phase of the motor vehicle in an activated charcoal filter, so that they do not get out into the environment. The drive system of such a motor vehicle is shown schematically in FIG. 1. Gasoline is stored in fuel tank 11 having a filling orifice 111. Degassing gasoline vapors from fuel tank 11 get into an active charcoal filter 121 of a fuel vapor recirculation system 12. Active charcoal filter 121 has a fresh air exit, so that fuel tank 11 is always pressureless. In order to avoid that active charcoal filter 121 "runs over", it is regenerated or desorbed in the operating phases of the internal combustion engine. For this, a dosing valve, or rather, a fuel tank vent valve 122 is opened. Fresh air flows through active charcoal filter 121 and guides the gasoline vapors adsorbed in it along, which are supplied downstream of a throttle valve 131 to an intake manifold 13. Through intake manifold 13, they are finally supplied to the combustion in internal combustion engine 14. The assumption is that in intake manifold 13 a certain underpressure prevails, that is, throttle valve 131 is not open to such a great extent. In full-load operation of internal combustion engine 14, for instance in the case of uphill travel, the intake-manifold pressure approaches the environmental pressure, and the pressure difference at tank ventilating valve 122 drops off With that, the desorbed quantity of gasoline vapors through tank ventilation valve 122 also drops off.

In the same way, a "nervous" driving style, which is characterized by high dynamics of the gas pedal, and with that, also of throttle valve 131, is able to lead to a lower regeneration quantity than a "quiet" driving style, which is typically recommended for a fuel-saving driving manner.

The regenerating operation takes place in a so-called time slice control, in which a regenerating phase is cyclically interrupted by a so-called base adaptation phase. The reason for this is that, in the base adaptation phase, basically mixture errors, such as a slow drifting of the fuel injectors is able to be identified, without being superimposed by the short-term, and frequently greatly fluctuating effect of the tank ventilation. The cyclically occurring base adaptation does, however, lead to the regenerating air quantity being restricted.

A further restriction of the generating air quantity takes place because tank ventilating valve 122 is only able to be opened to the extent that the gasoline vapor mass does not exceed the requirement of internal combustion engine 14 for fuel. Otherwise, internal combustion engine 14 would become overrich and would finally shut down. In practice, in the operating strategy of internal combustion engine 14, a great distance from the overriching boundary is maintained, for which the fuel supply, because of tank ventilation valve 122, usually makes no more than 30 to 40% difference in the fuel requirement of internal combustion engine 14.

The manner of functioning of tank ventilation valve 122 is monitored by various lawmakers in the course of certifying motor vehicles. For this, active charcoal filter 121 is removed before travel begins, and loaded with a test gas, so that it is saturated. Thereafter, activated charcoal filter 121 is installed in the vehicle, and, during travel operation, sufficient regeneration has to take place so that enough filtering capacity is available to take up the gasoline vapors accumulating from fuel tank 11 during travel. All motor vehicles which at least satisfy exhaust standard EU2, today have a tank ventilation valve 122, that is, for example, all newly admitted motor vehicles in the USA, in the European Union, in South Korea and in Japan.

The torque generated by internal combustion engine 14 is passed on to a transmission 15. Hybrid vehicles which, besides fuel tank 11 and internal combustion engine 14 also have a battery 16, which supplies an electric motor 17 with power, have operating phases in which electric motor 17 is running and is passing on, via transmission 15, its torque to a drive axle 18 and wheels 181, 182 fastened to it while internal combustion engine 14 is shut down. The shifting over between phases of the internal combustion engine operation and the electric motor operation takes place by a control unit 19. When internal combustion engine 14 is shut down and electric motor 17 is switched on, there can be no regeneration of fuel vapor recirculation system 12 taking place, although new gasoline vapor is constantly degassing from fuel tank 11 and is being absorbed in activated charcoal filter 121. The low purge air quantity of activated charcoal filter 121 leads to the fact that, for such hybrid vehicles, a high technical effort has to be made to pass the certification. Thus, it is known, for example, in hybrid vehicles that fuel tank 11 should be developed as a pressure tank, which holds fuel vapors at overpressure, so that they cannot flow into activated charcoal filter 121. In addition, in such hybrid vehicles, in which internal combustion engine 14 runs only rarely, there is the danger that activated charcoal filter 121 is saturated during operation and "runs over". This leads to the motor vehicle smelling of gasoline vapors, which leads to a bad vehicle image.

SUMMARY

In the method according to the present invention for operating a fuel vapor recirculation system in a motor vehicle having a fuel tank, predictive route data of the motor vehicle are used in the operating strategy of the fuel vapor recirculation system. By predictive route data one should understand, according to the present invention, data on the route still to be covered in the future by the motor vehicle which, for instance, may be taken from a navigation unit.

In the operating strategy of the fuel vapor recirculation system, data on the driving style of the driver are also preferably taken into account. The driving style may be ascertained, for example, by observing the accelerator dynamics of the motor vehicle on a level stretch of road, and stored, for instance, in a computer memory unit in the motor vehicle, for instance, in the control unit.

Regeneration of an activated charcoal filter of the fuel vapor recirculation system is preferably carried out when it is recognized from the predictive route data that the end of a trip of the motor vehicle is imminent after the expiration of a time period corresponding to a specified value. Thereby, at a known end of the trip, sufficiently long before the end of the trip, at the expense of the base adaptation, a regeneration of the fuel vapor recirculation system is carried out. This achieves that, when the motor vehicle is shut down, the activated charcoal filter is empty, so that, in a subsequent parking phase, the activated charcoal filter is able to absorb degassing fuel vapor from the fuel tank as completely as possible. This decreases the possibility that the motor vehicle smells of gasoline after a longer parking phase because the activated charcoal has "run over".

It is particularly preferred that the specified value is calculated from a loading factor of the activated charcoal filter. Depending on the temperature of the fuel in the fuel tank, more or less fuel vapor accumulates in the activated charcoal filter. The charging of the regenerating stream with fuel vapor is able to be ascertained in the engine controller. Thereby the charging factor is formed according to a method known from the related art. According to the present invention, as a function of this charging factor, calculating back from the known end of the trip, as of when the regeneration has to be begun so that the activated charcoal filter will be empty by the end of the trip.

Furthermore, it is particularly preferred that the specified value be determined while taking into account the geographical course of the route still to be covered by the motor vehicle until the end of the trip. By doing this, for the beginning of the last regenerating phase, the regenerating conditions may be drawn upon which prevail on the last route section. The generating performance of the activated charcoal filter on a route section may particularly be ascertained as a function of the rise and/or the height of the route section still to be covered. Uphill travel is unfavorable for regeneration, for instance, because of the wide-open throttle valve required for this. Low environmental pressure at great heights also lowers regenerating performance. As a function of the level of the active charcoal filter, the route sections still to be covered should admit the amount of regeneration that would leave the active charcoal filter empty at the end of the trip. For this calculation, it is preferred that for the rest of the trip the charging factor is assumed to be constant, i.e. the instantaneous fuel vapor accumulation from the fuel tank is assumed to be constant. Alternatively to the calculation of the prospective regenerating performance, according to the present invention, it is also possible that a computer memory unit in the motor vehicle, for example, the control unit, stores a route that has once been covered from the point of view of "regeneration friendliness". This regeneration friendliness also preferably includes the personal driving style of the driver. Then, when the route is covered again, a regeneration friendliness factor may be called up in order to estimate which regeneration performance is able to be attained on this route. This empirical solution has the advantage that the regeneration friendliness factor reflects the real regeneration conditions better, since it also takes into account the preceding traffic. On a route having frequent traffic jams, the regeneration conditions are clearly different than on free routes. For instance, a computer may form route sections in which the regeneration friendliness factor does not change substantially, in order to reach a data comprromise. A long plane, for example, is recorded as a single element and stored having a single regeneration friendliness factor. A subsequent rise, in turn, is recorded as an additional element and stored having a different regeneration friendliness factor.

Furthermore, it is preferred, according to the present invention, that regeneration of the active charcoal filter of the fuel vapor recirculation system is carried out when it is recognized from the predictive route data that the route to be covered by the motor vehicle, at least for a specified time period, only makes that regenerating performance of the activated charcoal filter possible which falls below a specified threshold value. In the case of foreseeable unfavorable regenerating conditions, as may be what occurs in a rapid sequence of alternating uphill and downhill travel, it is therefore possible to regenerate excellently. The method according to the present invention may also be used for motor vehicles that have an internal combustion engine and an electric motor. A usual operating strategy of such vehicles is oriented mainly to the energy receipt of the traction battery. When the battery is empty, the internal combustion engine is switched on, which then, besides moving the motor vehicle forward, is able to charge the battery at the same time. During downhill travel, the braking energy is typically recuperated and the battery is charged. Whenever the state of charge of the battery allows it, travel is performed either purely electrically or an acceleration process is boosted by an electric motor. According to the present invention, it is preferred that the predictive route data of the motor vehicle be taken into account in the operating strategy of the internal combustion engine and the electric motor. If the sum of the regenerating gas, on a predicted route, is not sufficient to empty the activated charcoal filter at its current level, then according to the present invention, the electric motor operation may be discontinued and the internal combustion engine switched on so that the time slice control is advantageously also discontinued in order to attain a maximum regenerating gas mass.

The computer program according to the present invention makes it possible to implement the method according to the present invention in a control unit that is already present, without this requiring structural changes. For this purpose, it executes all the steps of the method according to the present invention when it is run on a computer or a control unit. The data carrier according to the present invention stores the computer program according to the present invention. The control unit according to the present invention is obtained by playing the computer program according to the invention onto the control unit, which is developed to operate a fuel vapor recirculation system in a motor vehicle and a fuel tank using the method according to the present invention.

DETAILED DESCRIPTION

Figure 1:
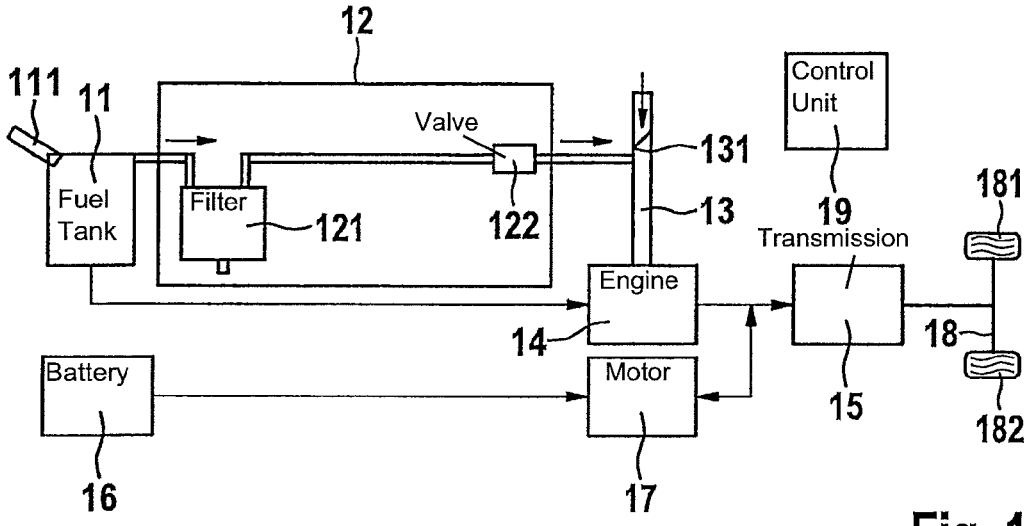
Fig. 1 (Prior Art)
FIG. 1 shows a schematic illustration of a drive system of a hybrid motor vehicle according to the related art.
Figure 2:
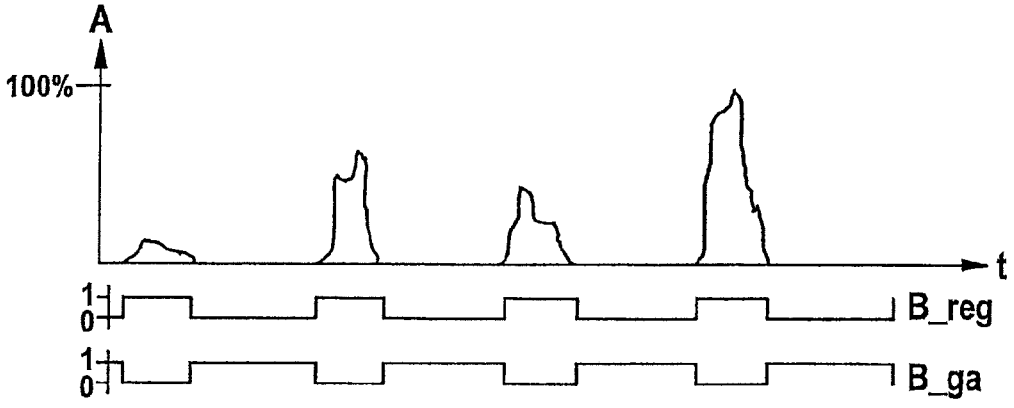
Fig. 2 (Prior Art)
FIG. 2 shows a curve over time of the actuation of a tank ventilation valve in an operating strategy according to the related art.
Figure 3:
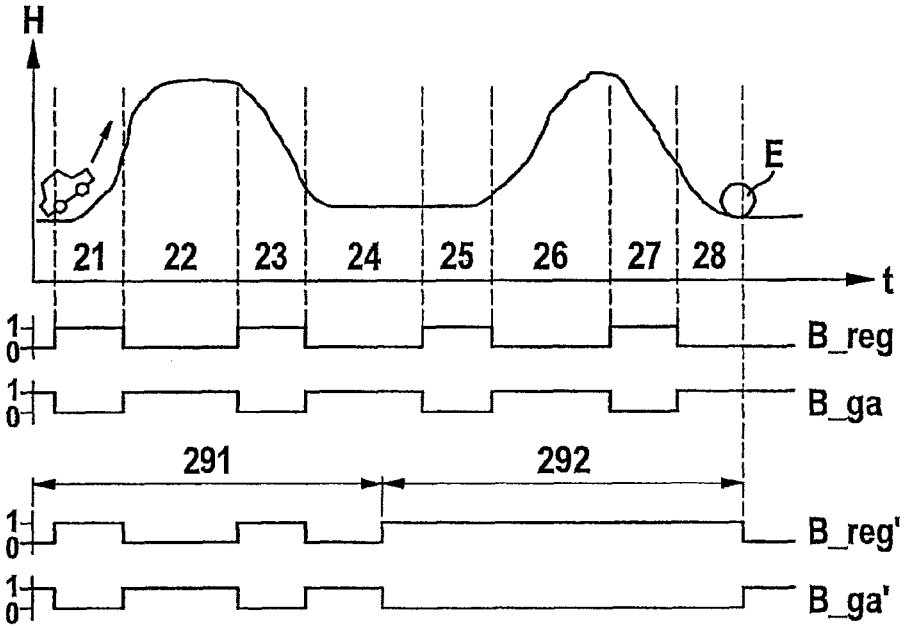
FIG. 3 shows the sequence of regeneration phases and base adaptation phases over time in an operating strategy according to the related art and an operating strategy according to one specific embodiment of the invention opposite to each other.

In one usual time slice control of the fuel vapor recirculation system 12 of an internal combustion engine, regenerating phases B_reg are cyclically interrupted by base adaptation phases B_ga. In one base adaptation phase (B_reg=0 and B_ga=1), no actuation A of tank-ventilation valve 122 of fuel vapor recirculation system 12 takes place. In regenerating phases (B_reg=1 and B_ga=0), an actuation A of more than 0% takes place. This is illustrated in FIG. 2. FIG. 3 shows how such an operating strategy works out in a travel curve. In this case, a motor vehicle travels along a route on which the geographic height H changes several times. In the usual method for operating the fuel vapor recirculation system, the travel is subdivided into phases 21, 22, 23, 24, 25, 26, 27, 28. In this instance, the base adaptation phases (B_reg=0 and B_ga=1) 22, 24, 26, 28 alternate with regeneration phases (B_reg=1 and B_ga=0) 21, 23, 25, 27. When end of trip E is preceded by a base adaptation phase 28, this has the result that, when the internal combustion engine is shut down, fuel has already been adsorbed by activated charcoal filter 121, and consequently not the entire adsorption potential of activated charcoal filter 121 is available for the parking phase of the motor vehicle. In one specific embodiment of the method according to the present invention, based on predictive route data, the imminent end of travel E is detected. While in a first time period 291, the operating strategy of the fuel vapor recirculation system 12 corresponds to the usual strategy, a regenerating phase 292 takes place in time before the end of the trip. It is longer than the regenerating phases of the usual operating strategy, since it is taking into account the unfavorable regenerating conditions at full-load travel in time period 26, in which the height of the terrain rises greatly.

Figure 4:
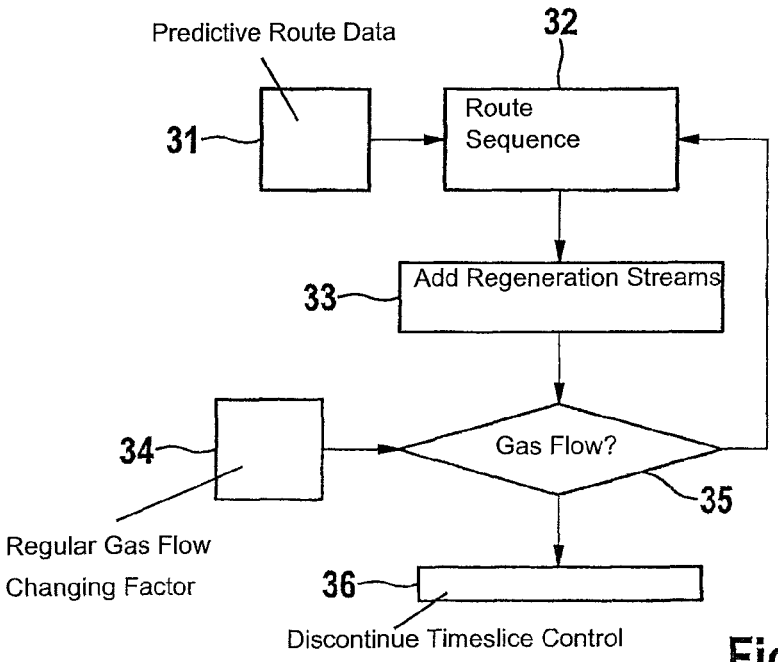
FIG. 4 is a flow chart of a method according to one specific embodiment of the present invention.

FIG. 4 schematically shows the sequence of one specific embodiment of the method according to the present invention for a motor vehicle, which is operated exclusively using an internal combustion engine 14. Predictive route data 31 are provided by a navigation unit of the motor vehicle. In a step 32, the route sequence is provided, starting backwards from the destination, i.e. from the destination to the current position, by section with regeneration friendliness factors. These may be determined either from data of the navigation unit based on the geographic condition of the route, or they are provided from empirical data which were collected during an earlier covering of the route. In a method step 33, possible regeneration streams up to the end of the trip are added up. A regenerating gas flow charging factor 34 is taken from the engine control, which corresponds to the level of activated charcoal filter 121. If the sum of future regenerating gas masses is sufficient to empty activated charcoal filter 121, on the assumption that there continues to be a constant gas flow from tank 11 into activated charcoal filter 121, the method is continued in a step 35 with step 32. Otherwise, the time slice control of fuel vapor recirculation system 12 is discontinued in step 36, and regeneration is initiated.

Figure 5:
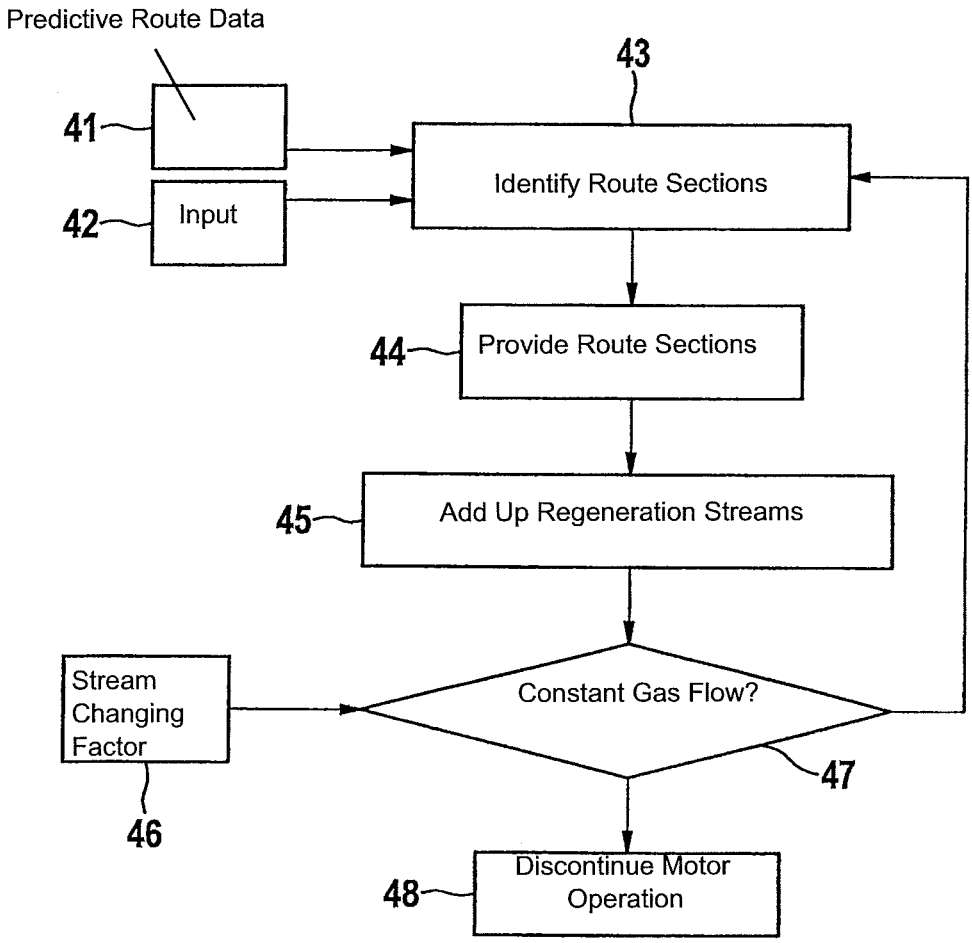
FIG. 5 is a flow chart of a method according to another specific embodiment of the present invention.

FIG. 5 schematically shows the sequence of one other specific embodiment of the method according to the present invention for a hybrid motor vehicle, which is driven using an internal combustion engine 14 and an electric motor 17. Predictive route data 41 are provided as in the preceding specific embodiment of the method according to the present invention. Furthermore, the operating strategy for switching over between operation of internal combustion engine 14 and operation of electric motor 17 is taken from control unit 19. Starting from these input data 41, 42, in step 43 route sections are identified which, starting backwards from the destination, are traveled using internal combustion engine 14. In a step 44, these route sections are provided by section with regeneration friendliness factors. In a step 45, possible regeneration streams up to the end of the trip are added up. Regenerating gas stream charging factor 46 is taken from the engine control. If the sum of future regenerating gas quantities is sufficient to empty activated charcoal filter 121, on the assumption that there continues to be a constant gas flow from tank 11 into activated charcoal filter 121, the method is continued in a step 47 with step 43. Otherwise, in a step 48 the electric motor operation is discontinued, internal combustion engine 14 is switched on and an uninterrupted regeneration of fuel vapor recirculation system 12 is initiated.

What is claimed is:

1. A method for operating a fuel vapor recirculation system in a motor vehicle that includes a fuel tank, comprising:

obtaining, by processing circuitry, route information including an identification of an end of a predicted route of the motor vehicle;

determining, by the processing circuitry and based on the identified end of the predicted route, a target manner in which to operate the motor vehicle to bring fuel vapor emissions to zero by a time at which the motor vehicle is estimated to reach the identified end of the predicted route; and controlling, by the processing circuitry, a vehicle component to operate the motor vehicle in the determined manner.

2. The method as recited in claim 1, further comprising:

carrying out a regeneration of an activated charcoal filter of the fuel vapor recirculation system when it is recognized from the predictive route data that an end of a trip of the motor vehicle is imminent after an expiration of a time period that corresponds to a specified value.

3. The method as recited in claim 2, further comprising:

calculating the specified value from a charging factor of the activated charcoal filter.

4. The method as recited in claim 2, further comprising:

determining the specified value while taking into account a geographical course of a route still to be covered by the motor vehicle until the end of the trip.

5. The method as recited in claim 1, further comprising:

carrying out a regeneration of an activated charcoal filter of the fuel vapor recirculation system when it is recognized from the predictive route data that a route to be covered by the motor vehicle, at least for a specified time period, only makes that regenerating performance of the activated charcoal filter possible which falls below a specified threshold value.

6. The method as recited in claim 4, further comprising:

ascertaining, as a function of at least one of a rise and a height of a route section that is still to be covered, which regenerating performance of an activated charcoal filter is able to be attained on the route section.

7. The method as recited in claim 4, further comprising:

ascertaining, as a function of a regenerating behavior during an earlier covering of a route section, which regenerating performance of an activated charcoal filter is able to be attained on the route section.

8. The method as recited in claim 1, wherein:

the motor vehicle includes an internal combustion engine and an electric motor, and the predictive route data of the motor vehicle is taken into account in an operating strategy of the internal combustion engine and the electric motor.

9. The method as recited in claim 1, further comprising:

taking into account a personal driving style of the driver of the motor vehicle in the operating strategy of the fuel vapor recirculation system.

10. A non-transitory computer-readable medium on which is stored a computer program that is executable by a processor and that, when executed by the processor, causes the processor to perform a method for operating a fuel vapor recirculation system in a motor vehicle that includes a fuel tank, the method comprising:

obtaining route information including an identification of an end of a predicted route of the motor vehicle;

determining, based on the identified end of the predicted route, a target manner in which to operate the motor vehicle to bring fuel vapor emissions to zero by a time at which the motor vehicle is estimated to reach the identified end of the predicted route; and controlling a vehicle component to operate the motor vehicle in the determined manner.

11. A control unit developed to operate a fuel vapor recirculation system in a motor vehicle having a fuel tank, the control unit comprising:

processing circuitry; and an output by which a vehicle component is controllable;

wherein the processing circuitry is configured to:

obtain route information including an identification of an end of a predicted route of the motor vehicle;

determine, based on the identified end of the predicted route, a target manner in which to operate the motor vehicle to bring fuel vapor emissions to zero by a time at which the motor vehicle is estimated to reach the identified end of the predicted route; and control, via the output, a vehicle component to operate the motor vehicle in the determined manner.

* * * * *